United States Patent [19]

Friedman

[11] 4,326,387

[45] Apr. 27, 1982

[54] FLUIDIC TIME DELAY SYSTEM

[75] Inventor: Donald E. Friedman, Creve Coeur, Mo.

[73] Assignee: Hussmann Refrigerator Co., Bridgeton, Mo.

[21] Appl. No.: 95,972

[22] Filed: Dec. 3, 1979

Related U.S. Application Data

[63] Continuation-in-part of Ser. No. 892,777, Apr. 3, 1978, Pat. No. 4,184,341.

[51] Int. Cl.[3] ..... F25B 39/04; F25B 1/00

[52] U.S. Cl. ..... 62/184; 62/228; 62/DIG. 17; 200/83 T

[58] Field of Search ..... 200/83 T; 62/511, 184, 62/DIG. 17, 158, 228

[56] References Cited

U.S. PATENT DOCUMENTS

| | | | |
|---|---|---|---|
| 2,558,830 | 7/1951 | Drane et al. | 200/83 T |
| 2,648,016 | 8/1953 | Gastle | 200/83 T |
| 2,847,835 | 8/1958 | Cooper et al. | 62/511 |
| 3,199,306 | 8/1965 | Paul | 62/158 |
| 3,513,662 | 5/1970 | Golber | 62/115 |
| 3,638,445 | 2/1972 | Lavigne et al. | 62/184 |
| 3,791,161 | 2/1974 | Kramer | 62/228 D |
| 4,184,341 | 1/1980 | Friedman | 62/228 D |

*Primary Examiner*—Albert J. Makay
*Assistant Examiner*—Harry Tanner
*Attorney, Agent, or Firm*—Richard G. Heywood

[57] ABSTRACT

A variable fluidic time delay system for operating a plurality of pressure sensitive control switches to effect sequential operations at different pressure settings or for different components in response to the fluid pressure at a predetermined location in a refrigeration system, the time delay system including a fluid flow restrictor and unidirectional flow control in parallel by-pass relation with each other and connecting the control switches to the predetermined location of the refrigeration system for restricting pressurized fluid flow with a concomitant time delay in one direction and providing unrestricted fluid pressure equalization in the other direction, respectively. The time delay system controls the operation of pressure responsive switches to sequentially and cyclically operate multiple parallel compressors at preselected upper and lower refrigerant suction pressures to maintain evaporator suction pressures within preselected ranges or to sequentially and cyclically operate multiple condenser fans at preselected refrigerant head pressures to effect zoned condenser cooling for adjusting effective condenser capacity and maintain low head pressures.

11 Claims, 2 Drawing Figures

FLUIDIC TIME DELAY SYSTEM

This application is a continuation-in-part of parent application Ser. No. 892,777 filed Apr. 3, 1978 for Suction Pressure Control System, now U.S. Pat. No. 4,184,341.

BACKGROUND OF THE INVENTION

The invention relates generally to multiple compressor refrigeration systems, and more particularly to improvements in time delay controls for the refrigeration system.

In recent years many advances have been made in the refrigeration art and especially in the commercial refrigeration field, which includes supermarket refrigeration and like installations having heavy refrigeration requirements over a wide range of temperatures from about −40° F. to about 50° F. (−40° C. to about 10° C.). So-called central refrigeration systems of the heavy multiplexing type utilize several compressors (typically either two or four) connected for parallel operation to effect refrigerant flow to and from the evaporators of a large number of refrigerated fixtures. Multiple compressor systems are generally controlled by pressure sensitive switches responsive to the suction pressure at the compressors intake so that as the suction pressure fluctuates in response to increases or decreases in system loads, the compressors will cycle on and off to maintain the common suction pressure on the system within prescribed limits to maintain proper temperature control of the refrigerated fixtures.

Fluctuation of the suction pressure is influenced by various internal (system) factors including temperature controls, defrosting apparatus and the like, and by several external factors including product loading of refrigerated fixtures, ambient temperatures and the like, and at times sudden transient increases in suction pressure may cause one or more idle compressors to start thereby rapidly reducing the suction pressure to the point where such compressors will cycle off again. Since these suction pressure changes are frequently transient in nature, the capacity of the operating compressors in the system would often be adequate to restore a normal suction pressure before there is any significant influence on the temperatures of the refrigerating fixtures. However, if the thermal load change causing the suction pressure (temperature) rise is of long duration, then the operation of one or more additional compressors may be necessary to maintain normal refrigerating fixture temperatures.

Wide fluctuations of the compressor head pressure may also be influenced by the same types of internal and external factors, and transient decreases in head pressure may be caused, for instance, by initial reduction of refrigerant loads as when a defrost cycle is started on selected fixture evaporators. Regulation of the effective condensing capacity can be controlled by the sequential and cyclical operation of a series of "zone" condenser fans controlled by pressure sensitive on-off switches so that, as the head pressure fluctuates, the fans will cycle on and off to change the condenser capacity toward maintenance of the head pressure on the system within prescribed limits. If such head pressure changes are transitory in nature, it may be desirable to maintain the operation of the condenser fans unless the decrease in head pressure persists.

It is apparent that electric power consumption will be reduced in the overall operation of the refrigeration system if additional compressors are not started in response to transient load increases, or if other system components are left idle during transient pressure fluctuations. It will also be apparent that the efficiency of such compressors will be increased when operated at lower head pressures, thereby effecting additional power savings. In the past, electric time delay relays have been used for delaying the start of additional compressors sensing an increase in suction pressure or for effecting sequential operation of other system components, but such electric relays are insensitive to the actual magnitude of the refrigerant pressure at the critical or predetermined location within the system, whereby the compressor, fan or other component controlled thereby will start no matter how small the difference is between actual pressure and the pressure switch setting. In short, heretofore there has been no simple, positive acting, pressure sensitive, time delay system for effectively obviating on/off component cycling due to sudden temporary or transient pressure changes.

SUMMARY OF THE INVENTION

The invention is embodied in a fluidic time delay system for operating a plurality of control switches having preselected pressure settings to effect sequential component operations in response to variations in refrigerant pressure at a predetermined location within the refrigeration system, the time delay system including restrictor means for delaying refrigerant flow and concomitant pressure communication in one direction of flow between the predetermined location and the control switches, and one-way flow means for providing unrestricted refrigerant flow and concomitant pressure communication in the other direction of flow between the control switches and the predetermined location.

The principal object of the present invention is to provide a fluidic time delay system capable of immediate pressure equalization in one direction and delayed pressure equalization in the other direction between a given location in a refrigeration system and a plurality of pressure sensitive switching means for controlling refrigeration system components.

Another object is to provide high side or low side pressure responsive control apparatus for operating refrigeration system components at optimum pressures and obviating premature component cycling in response to sudden and transitory pressure changes.

Another object of the present invention is to provide improved suction pressure controls for a multiple compressor refrigeration system to substantially reduce short term on/off compressor cycling due to sudden transient changes in suction pressure.

Another object is to provide a fluidic time delay interposed between the suction header and the pressure sensitive switching means of multiple parallel compressors for delaying the transmission of sudden pressure increases in the suction header to the pressure switches and affording immediate pressure equalization from the pressure switches to the suction header upon decreases in suction pressure.

Still another object of the present invention is to provide a fluidic time delay interposed between the compressor discharge and pressure sensitive switching means of multiple condenser fans for providing immediate pressure equalization to the switching means upon increases in the head pressure and delaying pressure release in the switching means upon sudden decreases in the head pressure.

Another object is to provide a simple, positive acting, pressure delay control for operating the pressure sensitive switches of multiple parallel refrigeration system components and for stabilizing fluctuating transitory loads to minimize on/off component cycling.

These and still other objects and advantages will become more apparent hereinafter.

BRIEF DESCRIPTION OF THE DRAWINGS

In the drawings which illustrate preferred embodiments of the invention, and wherein like numerals refer to like parts wherever they occur.

DESCRIPTION OF THE PREFERRED EMBODIMENT

Figure 1:
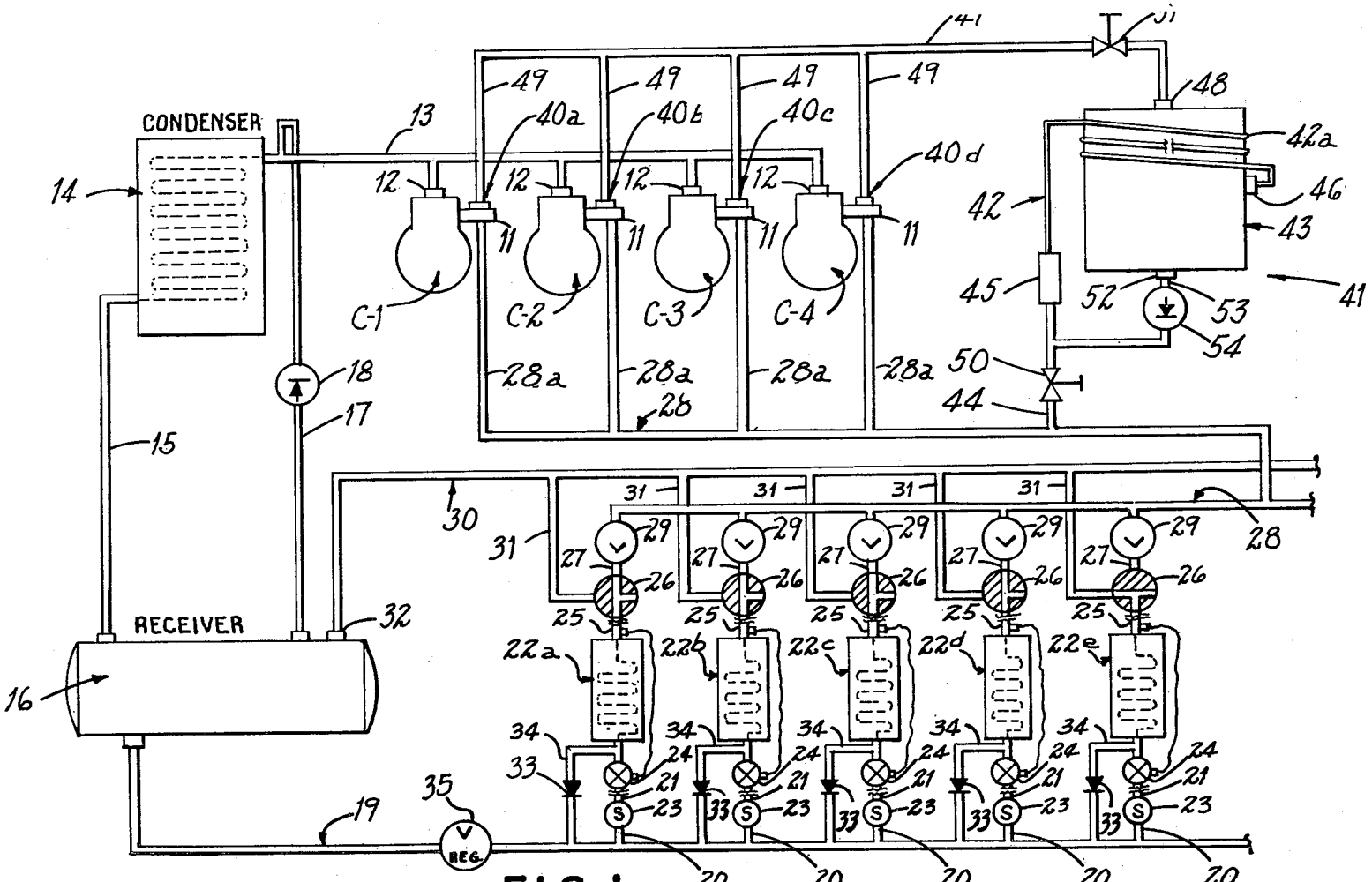
FIG. 1 is a diagrammatic illustration of a multiple compressor refrigeration system showing one embodiment of the invention.

Referring to FIG. 1, a central or multiplexed refrigeration system of the type having plural (at least two) compressors will be described as being installed in a supermarket for operating a multiplicity of separate refrigerated fixtures, such as refrigerated storage and display cases, but it will be understood and readily apparent to those skilled in the art that such a system can be adapted to other commercial or industrial installations. For disclosure purposes, the terms "high side" and "low side" are used herein in a conventional refrigeration sense to mean the portions of the system from the compressor discharge to the evaporator expansion valves and from the expansion valves to the suction intake of the compressors, respectively.

The central refrigeration system illustrated in FIG. 1 includes four parallel compressors C-1, C-2, C-3 and C-4, each of which has a suction or low pressure intake 11 operating within a range of preselected suction pressures (as will be described more fully) and a discharge or high pressure side 12 with a common discharge header or conduit 13 through which hot compressed gaseous refrigerant is discharged to a condenser 14. The refrigerant is reduced to its condensation temperature in the condenser 14, which is connected by conduit 15 to a receiver 16 forming a liquid refrigerant source for operating the system. A conventional equalization line 17 with a one-way valve 18 connects the top of the receiver 16 to the top of the condenser 14. The bottom of the receiver 16 is connected to a liquid header 19 for conducting liquid refrigerant to branch liquid lines or conduits 20,21 leading to evaporator coils 22*a*, 22*b*, 22*c*, 22*d* and 22*e*, which are representative of a multiplicity of different refrigerated fixtures (not shown). The branch liquid line 20 for each evaporator 22*a*, 22*b*, 22*c*, 22*d* and 22*e* is connected to a solenoid valve 23, and branch liquid line 21 leading therefrom is broken to illustrate an indeterminate length from the machine room to the refrigerated fixture. Expansion valve 24 are provided in the liquid lines 21 for metering refrigerant into the evaporator coils 22*e*–22*e* in a conventional manner during their refrigeration cycle. The outlets of the evaporators are connected by branch suction lines 25 (also broken to illustrate an indeterminate length) to three-way valves 26 and, under normal refrigerating operation, are connected through these valves and branch suction lines or conduits 27 to a common suction line or header 28 connected by compressor suction lines 28*a* to the suction inlets 11 of the compressors C-1, C-2, C-3 and C-4 and through which vaporous refrigerant from the evaporators is returned to the compressors to complete the basic refrigeration cycle. Evaporator pressure regulator (EPR) valves 29 are shown interposed in the branch suction lines 27 for illustrating that the suction pressure on the respective evaporator coils 22*a*–22*e* can be adjusted so that the respective refrigerated fixtures can be operated at different temperatures within the range of suction pressures maintained by the compressors C-1, C-2, C-3 and C-4.

The refrigeration system operates in a conventional manner in that each fixture evaporator absorbs heat from the fixture or its product load thereby heating and vaporizing the refrigerant and resulting in the formation of frost or ice on the evaporator coils 22*a*–22*e*, and periodic defrosts are therefor required. A main gas defrost header 30 is provided for conducting gaseous refrigerant selectively to the evaporator coils for defrost purposes and is connected through branch defrost lines or conduits 31 to the three-way valves 26, the three-way valve for the evaporators 22*e* being shown in defrost position.

In a conventional "hot gas" defrost arrangement the defrost header 30 would be connected to the compressor discharge conduit 13 so that this source of highly superheated hot compressed gaseous refrigerant would be used for selectively defrosting the evaporators 22*e*–22*e*. However, for disclosure purposes, the defrost header 30 is connected to the top of the receiver 16, as at 32, so that "saturated gas" from the receiver is used for defrosting purposes; that is, the sensible and latent heat of gaseous refrigerant at its normal or desuperheated saturation temperature is utilized for defrosting the evaporators. Accordingly, the gas defrost header 30 is connected to the top (32) of the receiver 16, which provides a continuous supply of saturated gas at substantially the head pressure of the compressors, so that such gaseous refrigerant will flow through the header 30, the branch line 31 and the three-way valve 26 into the evaporator coil 22*e* as shown (or other selected evaporators by actuating their respective three-way valves 26 and solenoid valves 23) for heating the coil and thereby condensing the refrigerant to its liquid phase as in a conventional condenser. A unidirectional by-pass or check valve 33 is provided in a by-pass line 34 connecting the inlet of each of the evaporators 22*a*–22*e* to the liquid header 19 in by-pass relation with the expansion valves 24. In accordance with the teachings of U.S. Pat. No. 3,150,498, the defrost system disclosed provides for the return of the liquid refrigerant resulting from the defrost of each evaporator coil directly into the liquid header 19 through the by-pass line 34 and check valve 33 for immediate use by the normally refrigerating evaporators. A pressure reducing or regulating valve 35 is positioned in the liquid header 19 upstream of the branch liquid supply lines 20; the pressure drop effected by the valve 34 from the receiver side of liquid header 19 to the evaporator side being in the range of about 15 to 40 p.s.i.g. (1 to 2.8 kilo/sq.cm). Accordingly, a pressure differential between the defrost gas header 30 and the liquid header 19 is maintained to provide an incentive for the rapid flow of refrigerant through the defrosting evaporator 22*e* (or other selected evaporator) back into the high side of the refrigeration system.

The compressors in conventional refrigeration systems are typically controlled by one or more multi-switch pressure controllers or a series of separate pressure switches having preselected high and low pressure settings which sense and are directly responsive to the low side suction pressure at the compressor intake 11 for starting and stopping the compressors. In such a system, the high or cut-in pressure settings for the multiple compressors are arranged in a preselected increasing progression to sequentially start the compressors only as required to meet increasing load demands and the cut-out or low pressure settings also vary in a preselected progression to stop the compressors sequentially as the system load evidenced by the suction pressure is reduced. In other words, the normal refrigeration load of the system may normally produce a suction pressure in the range of 10 p.s.i.g. to 12 p.s.i.g. (0.7 to 0.85 kilo/sq.cm) whereby the operation of two or three compressors in a four compressor system will be sufficient to satisfy the refrigerant requirements or load demands. However, in the event of sudden transient increases in suction pressure as when one or more selected evaporators (22*e*) ends a defrost cycle, the suction header pressure may rise very rapidly, such as to 35 p.s.i.g. (2.45 kilo/sq.cm) or the like, whereby the cut-in or high pressure settings of the control switches for all of the system compressors may be exceeded and normally all of these compressors would be started thereby rapidly reducing the suction pressure back below the cut-out or low pressure control settings of some compressors so that they would then cycle off. Manifestly, such rapid on-off cycling of compressors consumes unnecessary energy by reason of the fact that the operative compressors at the time of the surge in suction pressure may have been adequate to restore substantially normal suction pressure levels.

According to the FIG. 1 embodiment of the present invention, conventional types or arrangements of pressure responsive control switches 40*a*, 40*b*, 40*c* and 40*d* may be provided for controlling the operation of the compressors C-1, C-2, C-3 and C-4, respectively; i.e. such control switches 40*a*–40*d* may be of the conventional multi-switch controller type having a multiplicity of ganged switch contacts simultaneously actuated by a single pressure element or may be a series of separate or paired sets of conventional switches actuated by different pressure elements, the construction and operation of these conventional switch means being well known in the refrigeration art. It will also be understood that in conventional systems the location of suction pressure control switches is generally at the suction intake 11 of the compressors or in communication with the compressor suction lines 28*a* leading thereto from the suction manifold 28; whereas in the present system, the physical location of the control switches 40*a*–40*d* may be remotely located away from the compressors electrically controlled thereby. For disclosure purposes, however, these switches 40*a*, 40*b*, 40*c* and 40*d* are diagrammatically illustrated as being positioned adjacent to the suction intake 11 of each of the compressors C-1, C-2, C-3 and C-4, respectively, but they are isolated from the compressor suction inlets 11 and suction lines 28,28*a* and are arranged for compressor control operation through a fluidic time delay system 41, as will now be described.

The time delay system 41 is interposed between the suction header 28 and each of the pressure responsive control switches 40*a*–40*d* for regulating the vapor pressure imposed on these switch means to thereby electrically control the operation of the compressors C-1 through C-4. The time delay relay 41 is physically positioned above the suction header 28 to prevent the entrapment of oil therein, and comprises fluid restrictor means in the nature of a capillary tube 42 and an accumulator tank 43 to restrict refrigerant flow from the suction header 28 and thereby delay the concomitant vapor pressure increase effective on the pressure switches during increasing suction header pressures. A conduit 44 connects the suction header 28 to one end of a fine mesh strainer 45 for trapping any solid particles entrained in the refrigerant vapor flow and preventing the passage of such matter into the capillary tube restrictor 42 connected to the outlet of the strainer 45. It will be noted that the strainer is vertically disposed and in gravity flow relationship with the suction header 28. The capillary tube 42 comprises a substantial length of small bore tubing which is helically wound around the upper portion of the accumulator tank 43 in a gravity flow, downward spiralling series of turns 42*a* (shown broken to illustrate additional turns) and having its inlet connection 46 in the side wall of the accumulator intermediate its top and bottom ends. A conduit 47 is connected to the top 48 of the accumulator, and is connected by branch conduits 49 to each of the pressure control switches 40*a*, 40*b*, 40*c* and 40*d* to provide open fluid communication between the internal pressure actuator elements (not shown) of the switches and the upper portion of the accumulator 43. Normally open service hand valves 50 and 51 are provided in the conduits 44 and 47, respectively. It will be understood that the restrictor means utilizes capillary (flow restricting) tubing 42 of predetermined length and bore size and an accumulator 43 of predetermined volume which together are calculated to obtain optimum time delay in the flow of refrigerant vapor from the suction header 28 to the pressure switches 40*a*–40*d*. Manifestly, a capillary of smaller bore and/or an accumulator of larger size will result in longer time delays.

The time delay system 41 also includes fluid return or pressure equalizing means comprising a conduit 53 connecting the bottom 52 of the accumulator tank 43 to the conduit 44 between the strainer 45 and the hand valve 50, and a one-way check valve 54 is provided in the conduit 53 to provide relatively unrestricted, but unidirectional, refrigerant flow from the bottom of the accumulator tank back to the suction header 28 upon any relative decrease in the suction pressure therein.

The components of the time delay system 41 may be conveniently arranged in a suitable housing (not shown) mounted in gravity flow position above the suction manifold 28 and the compressors C-1, etc.; and the pressure control switches 40*a*–40*d* may be incorporated into such housing thereby requiring only relatively short conduit connections 47,49 between the accumulator 43 and the internal pressure actuator (not shown) of the compressor sequencing switches 40*a*–40*d*.

In the operation of the FIG. 1 embodiment, it will be understood that the pressure settings of the compressor control switches 40*a*–40*d* will be determined primarily by the requirements of the refrigeration system, type of refrigerant, load variables and the like. In a four compressor system (as illustrated) for low temperature (frozen food) operation at −25° F. (−32° C.) using Refrigerant 502, a typical suction header pressure range of about 4 p.s.i.g. to 15 p.s.i.g. (0.28 to 1 kilo/sq.cm) would be maintained and a normal suction pressure level of about 10 p.s.i.g. to 12 p.s.i.g. (0.7 to 0.85 kilo/sq.cm) would typically be established during normal, stable refrigerating conditions. Accordingly, in describing the operation of the fluidic time delay system 41 under these conditions, the sequencing switches 40*a*–40*d* may have the following high or cut-in and low or cut-out pressure control settings for starting and stopping the compressors:

| | | Cut-In | | Cut-Out | |
|---|---|---|---|---|---|
| Compressor | Switch | psig | kilo/sq.cm | psig | kilo/sq.cm |
| C-4 | 40d | 15 | 1 | 10 | 0.7 |
| C-3 | 40c | 13 | 0.9 | 8 | 0.56 |
| C-2 | 40b | 11 | 0.77 | 6 | 0.42 |
| C-1 | 40a | 9 | 0.63 | 4 | 0.28 |

It will also be assumed that compressors C-1, C-2 and C-3 are running and that the suction header pressure is stable and balanced with the accumulator tank 43 at 10 p.s.i.g. (0.7 kilo/sq.cm), that compressor C-4 is stopped, and that all evaporators 22*a*–22*e* are connected for normal refrigeration.

Under such circumstances, a defrost cycle is initiated for evaporator 22*e* by closing its solenoid valve 23 and switching the three-way valve 26 to the position shown, thereby resulting in a drop in the system load and reducing the suction header pressure to 6 p.s.i.g. (0.42 kilo/sq.cm). A pressure differential is thus created between the suction header 28 and the accumulator tank 43 causing the check valve 54 to open and the accumulator pressure to rapidly equalize at 6 p.s.i.g., which is below the 8 p.s.i.g. cut-out pressure of compressor C-3 causing that compressor to stop. The suction header pressure will slowly rise to 8 p.s.i.g. (0.56 kilo/sq.cm) due to the reduced compressor capacity, and the accumulator pressure will also slowly rise but lag behind the increase in the suction header due to the restrictive flow through the capillary tube 42. However, compressor C-3 remains idle and will not start until the accumulator pressure again rises to 13 p.s.i.g. (0.9 kilo/sq.cm).

When the defrost cycle of evaporator 22*e* is terminated and refrigeration is resumed, the coil is hot from defrosting and the suction pressure affected thereby rapidly rises to 35 p.s.i.g. (2.45 kilo/sq.cm) and this pressure increase is imposed on the fluidic time delay 41. Since the check valve 54 prevents direct pressure equalization to the accumulator 43, vapor flow in the accumulator is restricted through the capillary tube 42 and the concomitant vapor pressure increase in the accumulator 43, which is effective on the pressure switches 40*a*–40*d*, is relatively slow. The suction pressure in the header 28 drops rapidly as the warm coil 22*e* becomes cold and may read 11 or 12 p.s.i.g. (0.77 or 0.85 kilo/sq.cm) before the effective pressure in the accumulator 43 can reach 13 p.s.i.g. (0.9 kilo/sq.cm), which is the cut-in pressure of compressor C-3. Even if the suction pressure leveled out and come down to about 15 p.s.i.g. (1 kilo/sq.cm) as is typical, the rate of fluid flow and/or pressure increase to the accumulator 43 would be slowed down thereby allowing more time for compressors C-1 and C-2 to bring the suction pressure to below 13 p.s.i.g. (0.9 kilo/sq.cm) before the accumulator pressure effective on the pressure switch 40*c* reaches this cut-in pressure of compressor C-3. In the event the suction pressure on header 28 still exceeds 15 p.s.i.g. (1 kilo/sq.cm) when the accumulator pressure reaches 13 p.s.i.g. (0.9 kilo/sq.cm), the compressor C-3 will start thereby rapidly reducing the suction header and accumulator tank pressure back to the 10 p.s.i.g. (0.7 kilo/sq.cm) level.

From the foregoing it will be apparent that the time delay system 41 provides a variable time delay based upon pressure differential. If the suction header pressure rises slowly as when the load changes are due to increasing ambient temperatures or the like, the accumulator pressure will closely follow the suction pressure so that an additional compressor will start when needed without any significant time delay. If the rise in suction header pressure is rapid and substantial, such as 20 to 25 p.s.i.g. (1.4 to 1.76 kilo/sq.cm), due to surges occasioned by defrost operations (as described) or momentary load fluctuations as when cooler doors are opened, the accumulator pressure will follow relatively rapidly if the high pressure differential is sustained. However, if the pressure surge peaks and then drops rapidly, the differential will, of course, be decreased and the length of time for the accumulator pressure to reach the cut-in point of the next compressor will be increased. It will also be apparent that there is no significant delay in stopping a compressor when the suction header pressure drops below the accumulator pressure, as the one-way check valve 54 provides substantially unrestricted pressure equalization to stop compressors due to lighter load conditions. Effective time delays ranging from about 3 to 4 minutes up to about 15 or 20 minutes due to increasing suction pressures, together with substantially no delay due to pressure drop substantially eliminates short cycling of the compressors.

Figure 2:
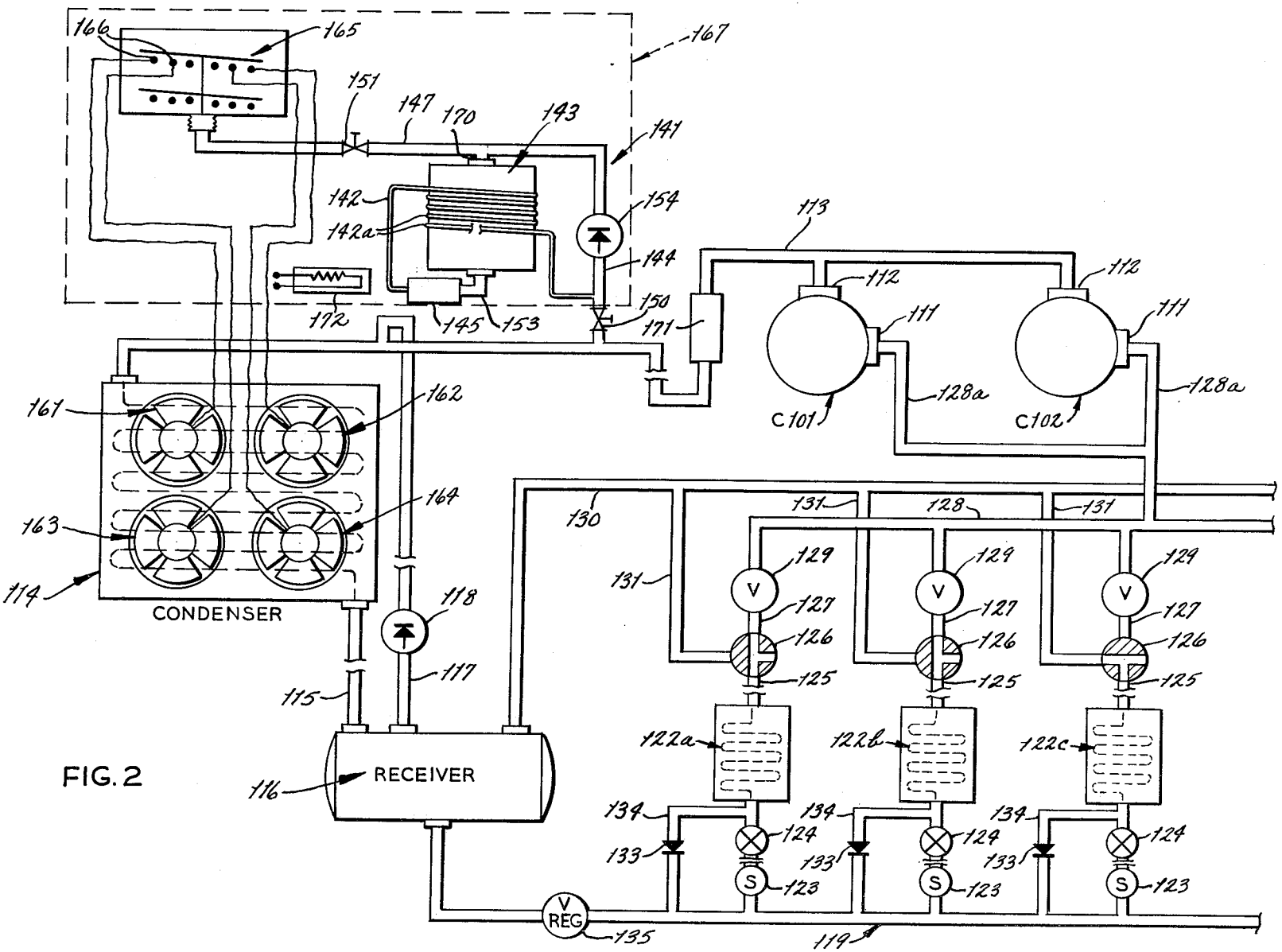
FIG. 2 is a diagrammatic illustration of a refrigeration system showing another embodiment of the invention.

Referring now to FIG. 2 of the drawings, the components of another refrigeration system are identified by numerals similar to those in the FIG. 1 embodiment, but in the "100" series. The basic refrigeration cycle is similar to that previously described, but for illustration purposes, only two compressors C101 and C102 are shown (such a system is frequently referred to in the commercial refrigeration trade as a "twin" system), and it will be understood that the invention may be useful even in a single compressor system. Also, only three evaporators 122*a*, 122*b* and 122*c* for refrigerated fixtures are shown with the evaporator 122*c* being in the defrost mode.

In the FIG. 2 embodiment of the invention it will be seen that a fluidic time delay system 141 may be piped in a reverse manner to that shown in FIG. 1 to facilitate different sequential pressure control functions. In the FIG. 2 embodiment the condenser 114 is air-cooled by a plurality of area or zone fans 161, 162, 163 and 164, each of which is selectively operated to control one quadrant of the condenser 114, as is typical, and the condensing capacity is thereby effectively regulated toward maintaining the compressor head pressure within a prescribed optimum pressure range of approximately 175 p.s.i.g. (12.25 kilo/sq.cm) to 185 p.s.i.g. (12.95 kilo/sq.cm). The compressor head pressure will, of course, vary widely depending on climatic conditions and system loads and it is desirable that a minimum head pressure of about 175 p.s.i.g. (12.25 kilo/sq.cm) be maintained to provide effective refrigerant pressure in the system, and that the condenser fans 161–164 be operated as needed to prevent the head pressure from exceeding a maximum of about 225 p.s.i.g. (15.75 kilo/sq.cm) as during summer operations.

According to the FIG. 2 embodiment of the present invention, a conventional pressure sensitive, multi-stage sequencer 165 having plural control switch contacts 166 may be provided for operating the motors of the condenser fans 161–164 in a sequential manner as needed in response to the compressor head pressure. It will be understood that a series of separate or paired sets of conventional pressure switches may be used as previously described in the FIG. 1 embodiment, but a multi-switch controller 165 is presently preferred for cycling electrical loads at remote locations from the refrigeration control point; in this case the compressor discharge line 113.

The fluidic time delay system 141 is interposed between the discharge line 113 and the control switch sequencer 165 for regulating the high side pressure imposed on these switch means to electrically control the operation of the condenser fans 161–164, and the time delay system 141 and sequencer 165 may be conveniently encased in a control box or housing 167. The time delay relay 141 is physically positioned in gravity flow relation above the discharge line 113 to prevent entrapment of oil therein, and includes a unidirectional valve 154 having its inlet side connected by an unrestricted take-off conduit 144 to the discharge line 113, and is being connected on its outlet side by another unrestricted conduit 147 to the multi-switch controller 165 so that substantially unrestricted refrigerant flow is provided from the high pressure discharge line 113 through the one-way valve 154 to the sequencer 165 for immediate pressure equalization upon relative increases in the head pressure of compressors C101 and C102. The sequencer 165 is pre-programmed to sequentially close the contacts 166 to the different fan motors at selected incremental pressure increases, as follows:

| Fan | Cut-In Pressure | |
|---|---|---|
| | p.s.i.g. | kilo/sq.cm |
| 161 | 175 | 12.25 |
| 162 | 177 | 12.39 |
| 163 | 179 | 12.53 |
| 164 | 181 | 12.67 |

Thus, at each two pound increase in the head pressure an additional condenser fan will be started to immediately increase the condensing capacity toward maintaining head pressures in the 175 to 185 p.s.i.g. (12.25 to 12.67 kilo/sq.cm) range.

It will be apparent that the head pressure is subject to relatively rapid fluctuations due to changes in system and environment conditions and due to changing condenser capacity by reason of the starting and stopping of the fans 161–164. Accordingly, the condenser fans 161–164 are subject to short cycling on and off, and it is desirable to stabilize fan operation and prevent hammering as well as maintain condenser capacity during transitory surges and drops in compressor head pressure as may occur at the start of an evaporator defrost cycle.

Accordingly, the time delay system utilizes fluid restrictor means in the form of a capillary tube 142 and an accumulator 143 to restrict the flow of vapor pressure from the pressure switches 165 back to the discharge line 113 for delaying pressure equalization during short term decreases in the head pressure. The accumulator 143 has an upper connector 170 in open pressure flow communication with the conduit 147 so that the pressure in the accumulator will become equalized to the compressor head pressure acting through the unidirectional valve 154 and conduit 147 directly to the control switches 165,166, although such pressure equalization in the accumulator will be delayed depending upon the size of the accumulator 143 and the precise physical hook-up, e.g. the outlet of valve 154 and the sequencer 165 may both be directly connected into the upper portion of the accumulator 143. The bottom of the accumulator has a bottom outlet conduit 153 connected to a strainer 145 immediately adjacent to the capillary tube 142, which has a single short upward turn and is then helically wound around the upper portion of the accumulator tank 143 in a gravity flow, downward spiralling series of turns 142*a*. The lower end of the capillary 142 is connected into the conduit 144 connected to the discharge line 113. Thus, the sequencer 165 is directly responsive to pressure increases in the compressor head pressure acting through the one-way valve 154 and conduit 147 to sequentially operate the condenser fan 161–164, and the restrictor means utilizes capillary tubing 142 of predetermined length and bore size and an accumulator 143 of predetermined volume which together are calculated to obtain an optimum time delay in releasing pressure from the sequencer 165 back to the discharge line 113.

The fluidic time delay 141 and sequencer 165 may be housed together as a unit 167 arranged in gravity flow relation to the discharge line (except for the short vertical section of capillary 142) to prevent oil entrapment therein so that entrained oil in the high side of the system downstream of the conventional oil separator 171 will be returned to the system. Normally open service valves 150 and 151 are provided in the conduits 144 and 147, respectively.

It will be understood that the fluidic time delay 141 will often be operating in an ambient temperature below that of the condensing temperature and, therefore, is subject to liquid condensation in the accumulator 143. Accordingly, if needed, heating means in the form of an electric heater 172 or the like may be provided within the housing 167 or adjacent to the accumulator 143, and suitable thermostatic or other controls (not shown) may be utilized to minimize operation and power consumption.

The operation of the FIG. 2 embodiment will be readily understood from the foregoing description. The fluidic time delay 141 provides immediate condenser fan operation in response to increasing head pressures, and maintains such operation for sufficiently long intervals to eliminate short cycling and hammering in the fans as well as during short term decreases in compressor head pressure in order to maintain efficiency in condenser cooling. However, if the head pressure slowly decreases as when load changes are due to climatic conditions or the like, the pressure in the accumulator 143 will closely follow so that only the appropriate condensing capacity will be provided.

It will be readily apparent that the fluidic time delay 41,141 may be utilized in a refrigeration system to operate pressure responsive switches for high side or low side component control. Thus, the foregoing description is given only by way of illustration and example, and the invention is only to be limited by the scope of the claims which follow.

What is claimed is:

1. In combination with a refrigeration system having multiple compressor means and condenser means including multiple condenser fans; a plurality of pressure responsive control switch means to effect sequential operations of at least one of said compressor means and said condenser fans in said refrigeration system, and a fluidic time delay system for operating said switch means in response to the fluid pressure at a predetermined location in said refrigeration system, said time delay system being disposed between the predetermined location and the control switch means and comprising unidirectional flow means and flow restrictor means in parallel by-pass relation with each other, said unidirectional means providing substantially unrestricted pressure equalization in one direction between said predetermined location and said control switch means, and said restrictor means restricting pressure communication between said predetermined location and said control switch means in the opposite direction, whereby increases and decreases in the fluid pressure at said predetermined location will be immediately equalized in said control switch means in one direction of pressure change and will be delayed in the other direction of pressure change.

2. The fluidic time delay system according to claim 1, in which said unidirectional means comprises a one-way check valve.

3. The fluidic time delay system according to claim 1, in which said flow restrictor means comprises a capillary tube.

4. The fluidic time delay system according to claim 1, in which said flow restrictor means includes accumulator means in combination with another flow restricting device.

5. The fluidic time delay system according to claim 4, in which said other flow restricting device is a capillary tube of predetermined length and bore size.

6. The fluidic time delay system according to claim 5, in which a substantial portion of said capillary tube is helically wound around said accumulator means for gravity refrigerant flow therethrough.

7. The fluidic time delay system according to claim 4, in which the predetermined location of the refrigeration system comprises the compressor discharge line and said accumulator means comprises an accumulator tank having lower connector means and upper connector means in unrestricted communication with said control switch means, said unidirectional means being disposed for unrestricted pressure flow from the compressor discharge line to said upper connector means of said accumulator tank, and said other flow restricting device being disposed between said lower connector means of said accumulator tank and the compressor discharge line for delaying pressure equalization in the accumulator tank upon relative decreases in pressure in the compressor discharge line.

8. The fluidic time delay system according to claim 4, in which the predetermined location of the refrigeration system comprises the compressor suction line and said accumulator means comprises an accumulator tank having lower connector means and upper connector means in unrestricted communication with said control switch means, said unidirectional means being disposed between said lower connector means and the compressor suction line for substantially unrestricted pressure flow upon relative decreases in pressure in the compressor suction line, and said other flow restricting device being disposed between the compressor suction line and other connector means of said accumulator tank for delaying pressure equalization in the latter upon relative pressure increases in the former.

9. In combination with a refrigeration system having multiple compressor means and condenser means including multiple condenser fans; a plurality of pressure sensitive control switch means to effect sequential operations of at least one of said compressor means and said condenser means in response to the fluid pressure at a predetermined location in said refrigeration system, and a variable time delay system for operating said control switch means comprising accumulator means having upper connector means connected in vapor pressure communication to said plurality of control switch means and lower connector means adapted to be connected in vapor pressure flow to said predetermined location in the refrigeration system, one-way flow means interposed between one of said upper and lower connector means and said predetermined location for providing unrestricted vapor pressure equalization of the accumulator means with the predetermined location in one direction, and restrictor means interposed between the accumulator means and the predetermined location in parallel by-pass relation with said one-way flow means for restricting vapor pressure communication in the other direction, whereby increases and decreases of the vapor pressure at said predetermined location will be immediately equalized in said accumulator means in one direction of change and will be delayed in the other direction of change.

10. In a refrigeration system having a compressor and condenser means including multiple condenser fans adapted for selective operation to effect zoned condenser cooling for changing the effective condensing capacity; the improvement comprising pressure sensitive switch means adapted to be closed at preselected pressure settings for operating the condenser fans in a predetermined sequential order, time delay means connecting the switch means to the compressor discharge comprising one-way flow means providing unrestricted refrigerant flow and concomitant vapor pressure communication from the compressor discharge to the switch means upon relative increases in the compressor head pressure, and restrictor means for restricting refrigerant flow and delaying concomitant vapor pressure equalization from the switch means back to the compressor discharge upon relative decreases in the compressor head pressure.

11. The refrigeration system accoding to claim 10, in which said restrictor means of said time delay means includes an accumulator in unrestricted communication with said switch means and another restrictor device connecting said accumulator to the compressor discharge, and heating means adjacent to said accumulator and adapted for operation to prevent the build-up of condensed refrigerant in said time delay means.

* * * * *

Disclaimer

4,326,387.—*Donald E. Friedman,* Creve Coeur, Mo. FLUIDIC TIME DELAY SYSTEM. Patent dated Apr. 27, 1982. Disclaimer filed Apr. 13, 1983, by the assignee, *Hussmann Corp.*

The term of this patent subsequent to Jan. 22, 1991, has been disclaimed.

[*Official Gazette May 24, 1983.*]